US012760984B2

(12) United States Patent
Jiang

(10) Patent No.: US 12,760,984 B2
(45) Date of Patent: Oct. 13, 2026

(54) SYSTEM FOR TRACKING SHOOTING PERFORMANCE INCLUDING A RECOIL DETECTOR FOR TRIGGERING THE TRACKING

(71) Applicant: Chunyang Jiang, Bradenton, FL (US)

(72) Inventor: Chunyang Jiang, Bradenton, FL (US)

( * ) Notice: Subject to any disclaimer, the term of this patent is extended or adjusted under 35 U.S.C. 154(b) by 222 days.

(21) Appl. No.: 18/454,871

(22) Filed: Aug. 24, 2023

(65) Prior Publication Data

US 2025/0067533 A1 Feb. 27, 2025

(51) Int. Cl.
*F41A 33/02* (2006.01)
*F41G 3/26* (2006.01)

(52) U.S. Cl.
CPC ..... *F41A 33/02* (2013.01); *F41G 3/26* (2013.01)

(58) Field of Classification Search
CPC ..... F41A 33/00; F41A 33/02; F41A 33/04; F41A 33/06; F41G 3/26
See application file for complete search history.

(56) References Cited

U.S. PATENT DOCUMENTS

| | | | | |
|---|---|---|---|---|
| 5,716,216 | A * | 2/1998 | O'Loughlin | F41A 33/02 273/365 |
| 11,680,774 | B2 * | 6/2023 | Wichner | F41A 17/08 42/1.05 |
| 2017/0082390 | A1 * | 3/2017 | Morgan | H04B 1/04 |
| 2017/0176127 | A1 * | 6/2017 | Ferris | A63F 13/537 |
| 2022/0178657 | A1 * | 6/2022 | Gallery | G06T 11/00 |

* cited by examiner

*Primary Examiner* — Timothy A Musselman
(74) *Attorney, Agent, or Firm* — Robert Brownstein

(57) ABSTRACT

The recoil detection device detects the recoil associated with a person firing a firearm. The recoil device measures information using motion sensors such as an accelerometer, gyroscope, and magnetometer, and analyzes that information to indicate the firearm has been fired. The information is processed and aggregated to generate useful information to the person shooting the firearm and to anyone on the internet.

16 Claims, 7 Drawing Sheets

Logo|3"|FIXED 3|SS/PTSS|Indoor|12:45PM|3/15/2022|GEAR ICONS***

Today 's Session #001

1st Shot 0.00|Split time 0.00

START

Shot # 0|Rounds Per Minute 0

00.00 TOTAL TIME

PAUSE/RESUME|STOP

701

| | | |
|---|---|---|
| Session name | ABCDE | 00125 |
| Date | 1/15/2023 | 1/17/2023 |
| Total Time | 6.72 | 5.12 |
| Total Shots | 15 | 23 |
| Deatils | 2 | 2 |
| Per Timer | 2 | |
| | ⊖ | ⊖ |

702

Figure 7

SYSTEM FOR TRACKING SHOOTING PERFORMANCE INCLUDING A RECOIL DETECTOR FOR TRIGGERING THE TRACKING

BACKGROUND

Target shooting has always been a popular way to use firearms in a safe and controlled manner that allows for a person to analyze and hone their shooting skills. Target shooting can be done on a gun range or out in an open area. The problem with analyzing target shooting is that the feedback is either delayed, hard to judge as the accuracy of the shots and the shooter's actions, or both. In target shooting, there is usually an object that the shooter is aiming for, such as a paper, wood or metal target. The shooter has to retrieve the target after they are done with their target practice. This doesn't allow for instant feedback that would allow for a shooter to adjust their aim between shots based on the feedback as they won't know how well they shot until after they are done shooting multiple rounds.

DESCRIPTION OF RELATED ART

One way to overcome this lack of feedback has been to use acoustics to trigger a monitoring system. While this is accurate to track a single shooter, it becomes an issue with shooting on a range where multiple people are shooting. The additional sounds of gunfire can quickly overwhelm an acoustic sensor as gunfire is loud and echoes. Another way to trigger a monitoring system is to use a recoil sensor either on the firearm or on the person's body. The problem with this solution is that it either requires something that attaches to the firearm that could change the shooters aim, or they are too large and when attached to a person's body they can get in the way of the person's shooting, or be cumbersome to wear.

RELEVANT PRIOR ART

U.S. Pat. No. 10,663,259 discloses a gun monitoring system that tracks the motion of the firearm. While the patent discloses a sensor that attaches to a gun to sense motion, the system does not disclose measuring the recoil that happens when a firearm is fired. Instead the system measures the recoil anticipation which is the motion of the user's hand while holding the firearm before the firearm is fired. Recoil anticipation happens when an inexperienced person tries to fire a firearm, they jerk their hand before they shoot in anticipation of the expected recoil. This invention is meant for measuring the recoil of the firearm that occurs when the firearm is fired, which triggers the other sensor systems.

SUMMARY OF THE INVENTION

The overall scope of the invention is to provide a person with a system for accurately tracking and analyzing their shooting in real time. The system would include a recoil detection device that is small enough to be attached to a shooter's finger, but could also be placed on a wrist or arm, or even the firearm itself. The recoil detection device is small enough so that it wouldn't impact the shooters accuracy or be cumbersome to wear.

The recoil detection device contains an accelerometer, a gyroscope, and a magnetometer to detect when the shooter pulls the trigger and firearm discharges a bullet. While the device is small, it also needs to be rugged enough to withstand the recoil of the firearm, all types of weather conditions, and have enough battery life to last for an entire shooting session.

The recoil detection device contains wireless connectivity to connect it to a smartphone, tablet, computer, or any type of wireless computing device. This connectivity is used by the device to send and receive information to and from the computing device. The connectivity could also be used to communicate with other sensors, such as a video or still camera, and a timer device. When these devices are used in unison, they aggregate the information from the various sensors and provide the shooter with instant feedback as to their shooting performance including but not limited to target feedback, video/image feedback, timing information, wind speed, humidity, and temperature.

To protect the shooter's information the communication is encrypted between the sensor devices and the computing device. This prevents nearby shooters using the same system for interfering with the shooter's feedback. While it is preferable for all of the sensor devices to be used in unison, any number or combination of sensor devices could be used along with the recoil detector to give the shooter any feedback they require.

BRIEF DESCRIPTIONS OF THE FIGURES

FIG. 7 shows a detailed view of the timing information.

DETAILED DESCRIPTION

Figure 1:
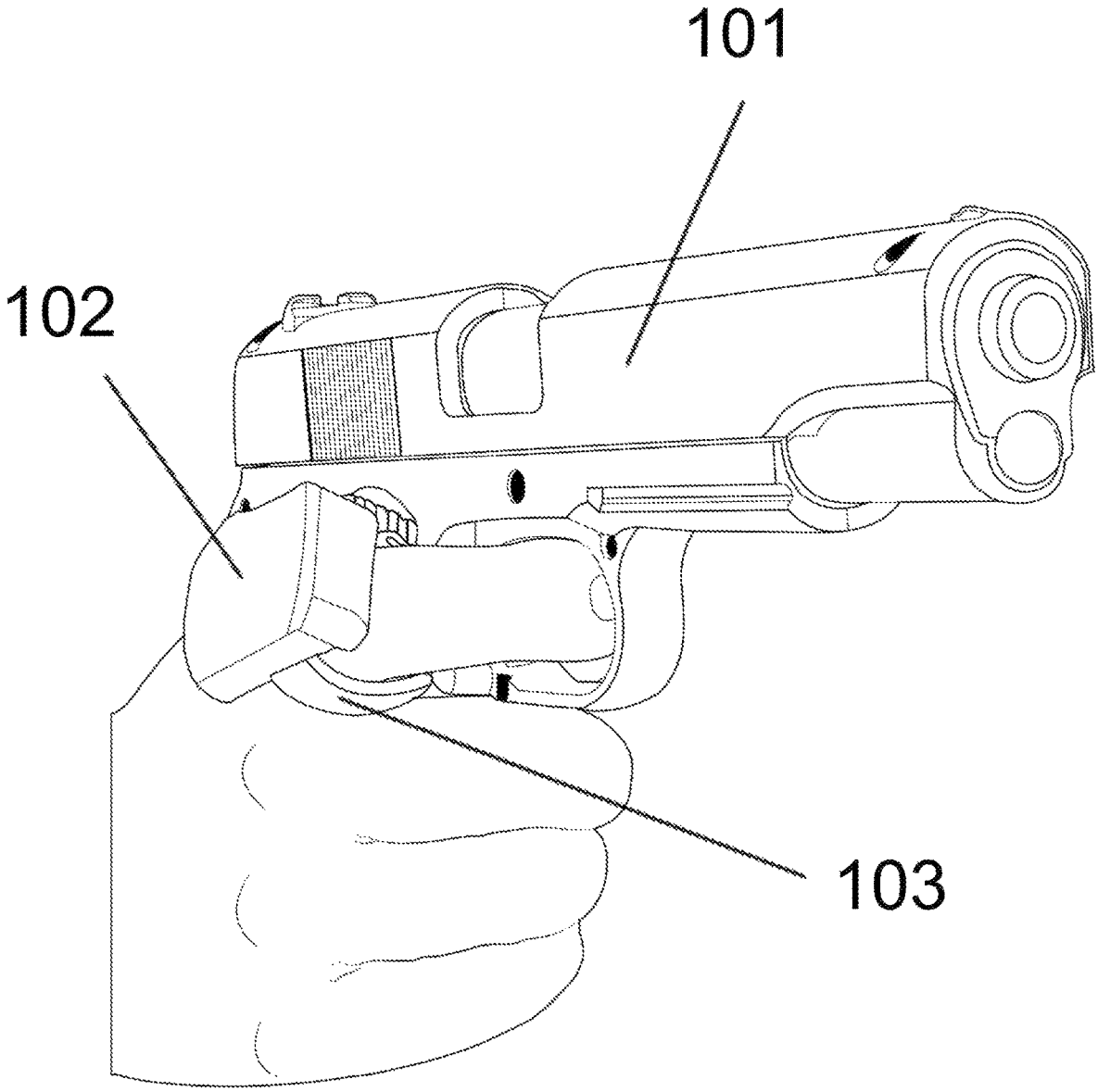
FIG. 1 shows the recoil detector attached to a user's finger.

FIG. 1 shows a preferred embodiment of the invention showing a person holding a pistol with their right hand, although the invention could be used on either hand. The recoil detecting device 102 would be attached to the user's finger via a strap 103, while they hold onto pistol 101. While a pistol will be shown in the figures, any type of firearm/shooting device could be used with the recoil detection device, including but not limited to a shotgun, a rifle, a bow, a revolver, a grenade launcher, and a blow dart. The recoil device is shown as being attached to the user's finger, but the recoil device could be, but is not limited to being, attached to a user's wrist, arm, body, or the firearm itself.

The recoil detection device would ideally be a 1.4"×1" form factor, but any size, shape, or weight could be used as long as the device's size, shape, and weight do not interfere with the user's ability to shoot. The device is made of a hardened plastic that allows for the device to weather the repeated firings, snow, rain, sleet, hail, wind, heat, or any other extreme conditions that the user is likely to experience. The device would be low in weight, without sacrificing the functionality of the device.

The recoil detection device would include sensors that provide data to an onboard processor using an algorithm to detect when the user's fires a firearm while the device is attached. The algorithm uses the sensor data, that includes but isn't limited to, data from an accelerometer(s), a gyroscope(s), and a magnetometer(s) to detect shot waveforms and accurately detect when a firearm is shot. The movement detected by the sensors would be in three dimensions. The sensitivity of the device could be adjusted by the user's phone, using an app to adjust the device for different types of firearms and/or ammunition. The shot information is preferably sent from the device to a user's phone via a Bluetooth connection, but any type of connection could be used, including but not limited to. Wifi, an adhoc network, NFC. RFID, and a wired connection, The device includes an input that include, but is not limited to, a physical button, a switch, a touch screen, and a dial, for changing settings and/or manually triggering a shot detection start event.

The recoil detection device would process the sensor data and provide a shot detection every 50 milliseconds, which would allow for the user to fire the firearm repeatedly, but could be any length of time that is less than the intervals between firings. The device would be preferably be powered by a lithium ion battery with voltage regulation and status monitoring performed via a combination of hardware and software, but could be any type of battery that is used in portable devices. The communication between the phone and the device would be encrypted and the user's identify would be authenticated on the user's phone, to ensure that the user's privacy was preserved. While a phone has been used to describe the user device that collects the data from the recoil detection device, any type of computing device could be paired with the recoil detection device, including but not limited to a tablet, computer, laptop, desktop, watch, or any device able to collect and display information to a user. In one embodiment, the recoil detection device and the user device could be integrated in to a smart watch that can output information to the user, removing the requirement for multiple devices. The phone could be used to control settings of the recoil detection device via a user interface that is displayed via the app.

The accelerometer sensor could consist of three accelerometers for detecting linear acceleration forces. The gyroscope sensor could consist of three orthogonal gyroscopes for detecting angular rotational forces. The algorithm uses the data from the sensors for performing pattern recognition on the data to identify impulse waveforms amid background data to prevent false positives. The strap, band, clip, or any other type of connector used to attach the recoil detection device to the user would be adjustable to allow for use by every type of shooter. The device could also use an adjustable clip, band or threaded holes to allow for the device to be attached to and removed from any type of firearm. The device could be customized with different straps that are different colors, have images or patterns, or material so that the user could customize their device.

Figure 2:
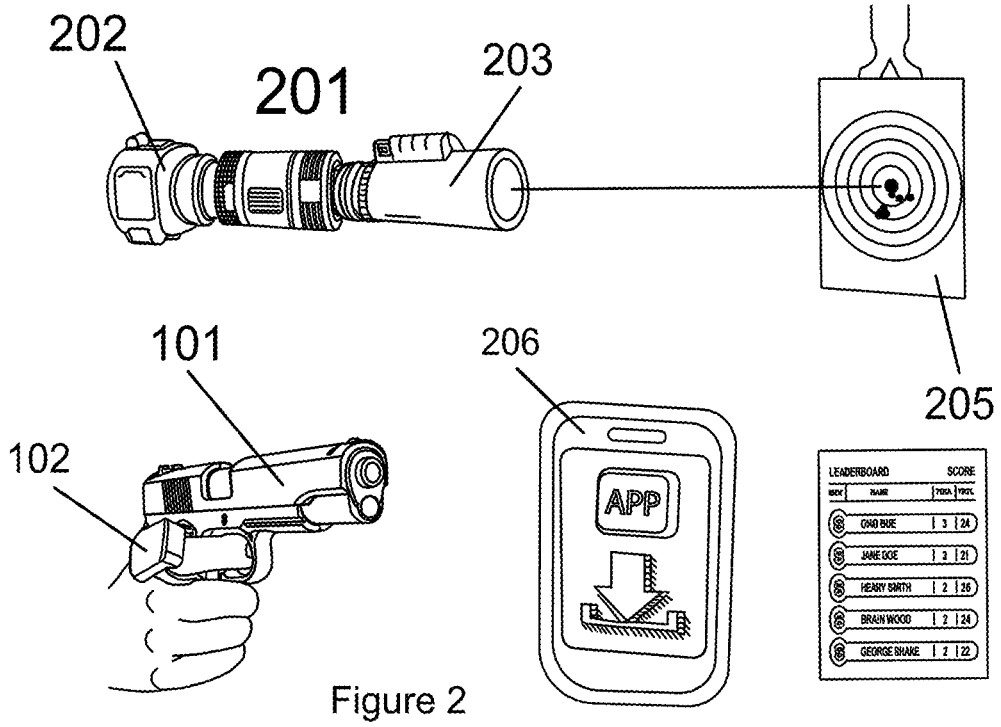
FIG. 2 shows an overall embodiment of the targeting system.

FIG. 2 shows an overview of the shot tracking system. The recoil detection device 102 is attached to the firearm 101 for detecting when the user fires the firearm 101. Information from the recoil device 102 is sent and received from the user's phone 206. The recoil information generated by the recoil device is sent to the phone to initiate a timer system to start a timer, which would indicate how long it takes a user to aim and shoot the firearm, along with how much time elapses between the firings. The phone also receives and sends information to the camera system 201. The recoil information can also be sent to the camera system directly from the recoil device or via the phone. The recoil information would trigger the camera system, which is aimed at the target, to start recording video or taking a series of still images that are relayed back to the phone. The phone uses an algorithm to analyze the video or still images to create an accuracy score that is displayed to the user on the phone. The information displayed to the user consists of, but is not limited to, image or where the bullet struck the target, an accuracy score based on a general scoring system or one that they have customized, and the timing information generated by the timer system. The information from the camera system would be used to determine when the bullet struck the target to determine the bullet travel time.

The shot tracking system uses all the information sent and received from/by the phone, recoil detection device, timer system, and the camera system to generate feedback for the user. This information could be aggregated by using AI or machine learning to learn the specifics of the user's shooting information and generate customized information to display to the user on the phone. The processing of the information could be performed locally on the phone or the phone could upload the information to a server to perform the processing, the information being sent from the server to the phone. The realtime feedback could be a numerical score using default scoring rules, customized rules inputted by the user, automatically generated by the phone, or any combination. The feedback could be sent to other user's phones that are using the same system to create a contest or leaderboard for all that are participating.

The camera system 201 would include a scope 203, with a lens or lenses, and a sensor 202. The sensor includes an eye piece that allows the user to aim the camera system at the target, but the camera system could also include an auto aiming feature where a motorized mount is used to hold the camera system, which would use image recognition to detect, focus, and aim at the target. The camera system uses edge detection, contour tracing, and shape matching for detecting when a bullet strikes the target. The phone could display new bullet strikes with a particular shape or color to differentiate them from the previous bullet strikes on the target. The camera system would also be able to determine when there is not a bullet strike, which would be outputted to the phone in the form of a miss alert and/or how far off target the bullet was from the target.

The shot timer system provides information indicating how long it takes the user to shoot. This information includes, but is not limited to, time to aim and shoot the firearm, time for the bullet to reach the target after the firearm was shot, the time it takes for the user to draw the weapon from a holster or other position, time between two or more shots, or any combination of these times. The feedback from the timer system would help a user work on their shooting speed, which combined with accuracy, would present to the user the most complete coaching information on the phone. The recoil system could use AI or Machine Learning to determine a pattern for the user's shooting style to enable the system to start the timer automatically when the user move's the firearm.

The shot tracking system provides the user with the ability to share the information on social network accounts, overlay data over the images, and connect the shooter to e-commerce sites to buy different firearms or accessories. The system could include a shooting coach feature that aggregates all the information from the various systems to provide the user with realtime adjustments to make to their stance, how the user holds the firearm, aim, and any other information that would help the user improve their shooting. Multiple camera systems could be used to capture multiple images of the target, including but not limited to, different angles in all three dimensions, an angle that shows the user, an angle that shows the user and the back of the target, angles that show the target from the sides, top or bottom. The shot tracking system could also use voice recognition software to allow for the user to control the system without taking their hand off of the firearm. The camera system could use any known and future type of image processing to enhance the images captured. The system could process the information locally or it could send and receive information from a cloud based system to reduce the processing requirements of the phone.

Figure 3:
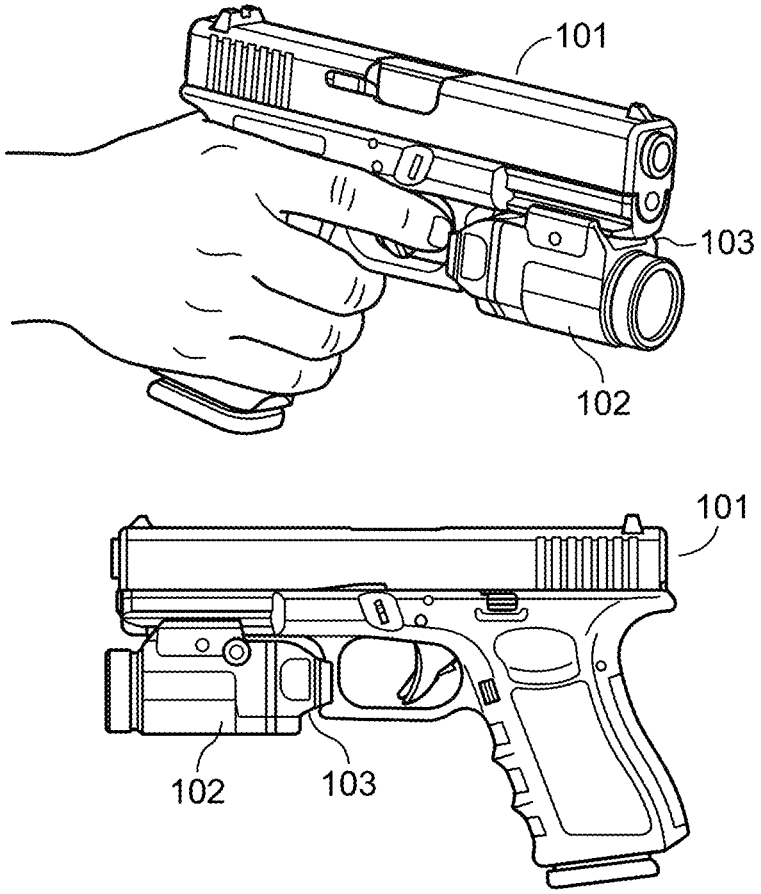
FIG. 3 shows the recoil detector mounted to a finger or firearm.

FIG. 3 shows the recoil detecting device that is attached to the user's finger or the firearm. The strap 103 is preferably made of a sturdy plastic or rubber, but could also be made out of any type of fabric. The strap is easily connected and disconnect from the recoil device to allow for the device to be customized with different accessories in any type of color or pattern and to allow for the strap and device to be cleaned.

Figure 4:
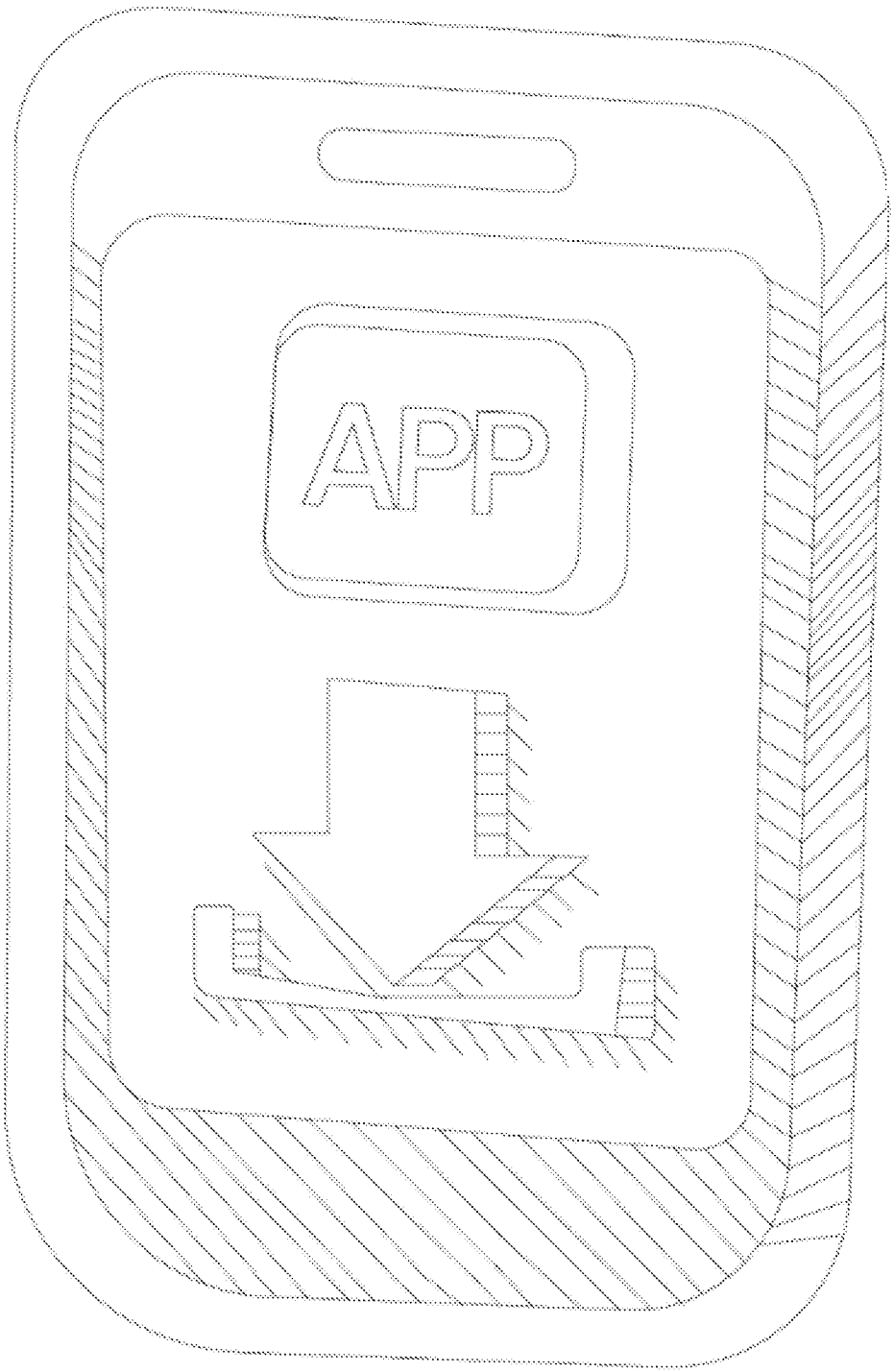
FIG. 4 shows a phone for running the app.
Figure 5:
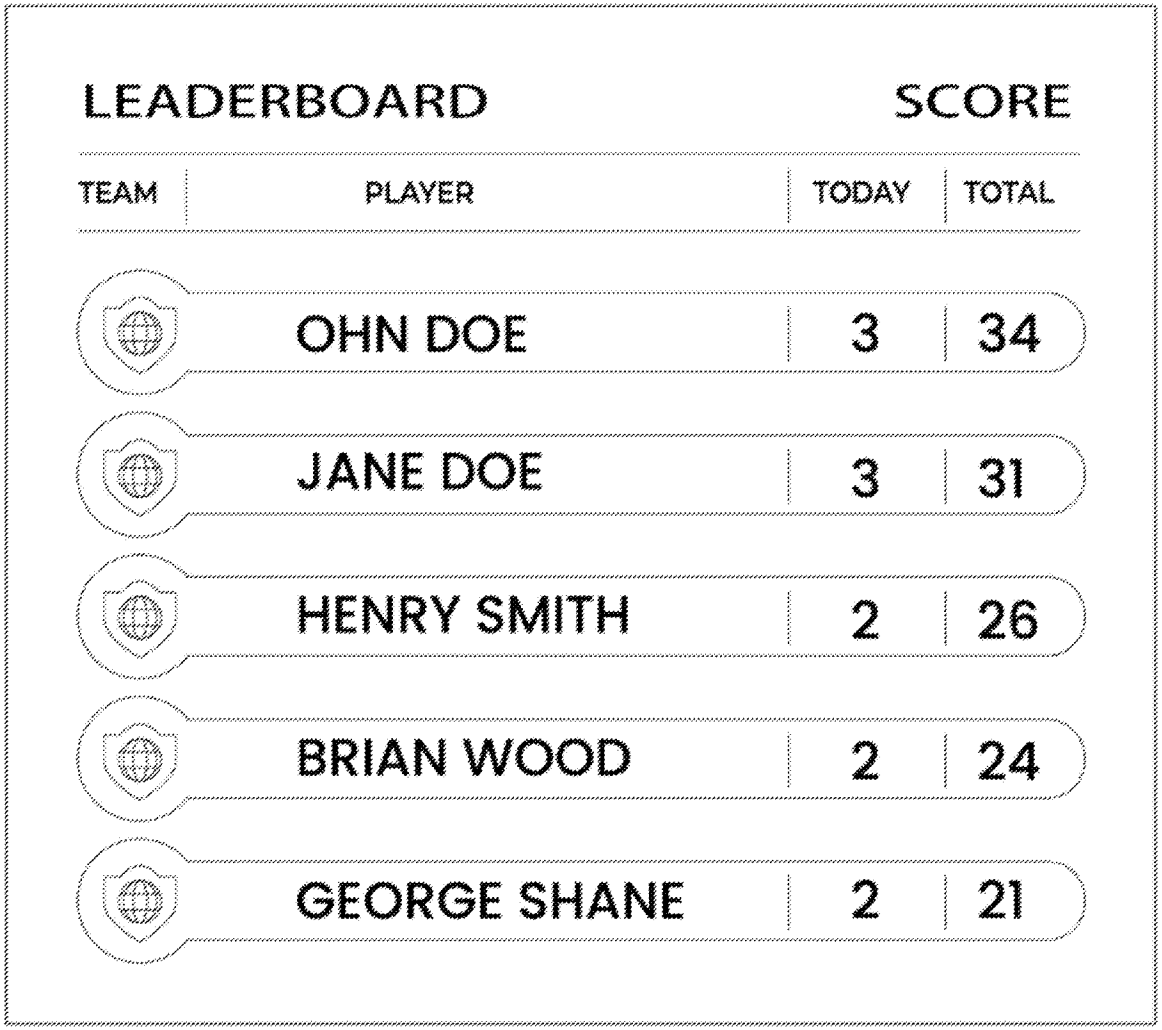
FIG. 5 shows an example of a GUI running on the app.

FIG. 4 shows an example of a user device, a phone that could run the shot tracking system app, but the user device could be a tablet, computer, laptop, watch. VR headset, AR headset, touchscreen TV, or any other device that can display data and be interacted with by a user. FIG. 5 shows an example of a GUI running on the app. The GUI displays a leader board update, which would show a live ranking of different shooter's scores. The shooters could be ranked by their overall score from multiple days or could be ranked for their scores for the current day. There could also be rankings that based on a specific contest for a single or multiple rounds.

Figure 6:
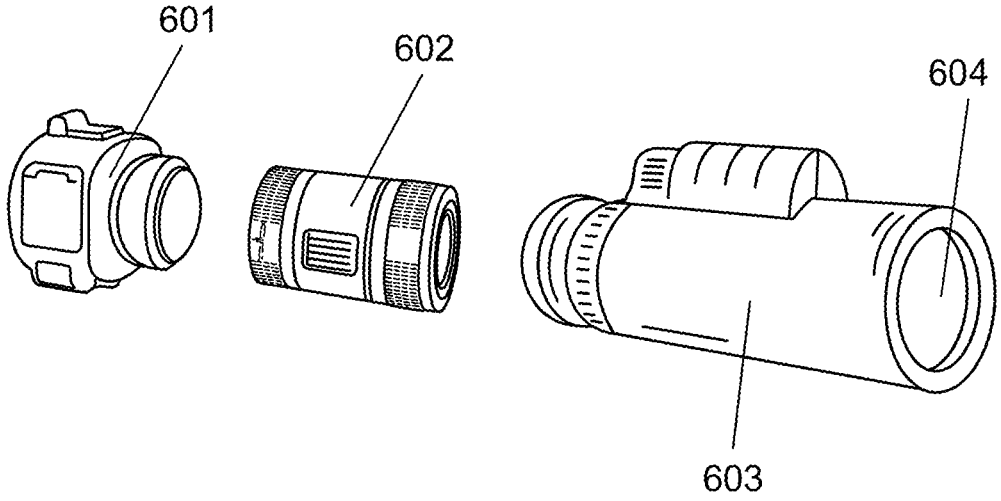
FIG. 6 shows an embodiment of the camera system.

FIG. 6 shows a disassembled view of the camera system. The camera sensor 601 that is preferably a CCD sensor, but any type of sensor with the ability to convert light information into digital signals could be used. Coupler 602 would connect the camera sensor to the scope 603. While shown as separate components, the camera system could be a single component or any number of separate components. The separate component design would be preferred as it would allow for each component to be upgraded separately, like a higher pixel count sensor and/or a different kind of lens. The lens could be a fixed focal length which would allow for a smaller scope to be used, or the scope could contain a zoom or telephoto lens that would allow for different length ranges to be shot on.

FIG. 7 shows examples of different detailed information displayed to the user via the phone. Screen 701 shows the detailed information for a single shooting session including, but not limited to, if the session is indoors or outdoors, time of the session, date of the session, the number of the session, the time to take a single shot or multiple shots, total shooting time, the split time, how many rounds were fired in a customizable window of time, and buttons to pause, resume, and stop the session. Screen 702 shows an interface for comparing different sessions that includes the options to delete sessions, display details for a single session, and the par timer for a session.

The recoil detection system could be used for personal shooting training, law enforcement or military training, teaching an inexperienced user how to shoot safely, or any other firearm related training. Information presented to the user on the phone could include, but is not limited to, ammunition tracking, video analysis, scenario based training, health warnings such as a warning about the user's hearing, maintenance reminders for the firearm, and in app purchases for adding software and/or hardware capabilities to the shot tracking system.

The devices mentioned above could be implemented using any type of processor architecture able to execute software including, but not limited to, x86, ENIAC, RISC, Pentium™, and Apple Silicon™. The software could be any type of code that is used to instruct a processor to perform instructions including, but not limited to, Python™, Java™, C+™, FORTRAN, and Assembly. The software could be stored on any type of non-transitory medium including, but not limited to, RAM, ROM, Flash Memory, Punch Cards, Plano Player Reels, Hard Drives, and physical servers.

I claim:

1. A firearm analysis system for use with a firearm with a trigger comprising:

a recoil detecting device configured to be mounted to a user or to the firearm and including at least one movement sensor configured to sense movement of the firearm when it is fired and to generate motion data at discrete sampling intervals representing impulse waveforms corresponding to recoil;

a timer device for firearm movement, the timer device being configured to detect an act of shooting the firearm and to control timing measurement, wherein the timer device receives information from the recoil detecting device identifying a recoil event corresponding to discharge of the firearm and uses the recoil event to trigger timing measurement;

a user device with a display, the user device being in communication with the recoil detecting device and the timer device to receive the motion data and timing information and to compute, from the motion data representing impulse waveforms and the timing information, at least one performance metric for a user that combines (i) timing data related to firing the firearm, and (ii) accuracy data derived from characteristics of the impulse waveforms measured over the discrete sampling intervals;

wherein the user device is configured to display to the user, on the display, information including an elapsed time related to firing the firearm, an elapsed time between successive firings, and the at least one performance metric that combines the timing data and the accuracy data.

2. The system of claim 1, wherein the timer device is further configured to detect that the user has raised the firearm into a firing position based on an orientation and motion pattern sensed by the movement sensor, and to arm the timer to start in response to a subsequent trigger movement event when the firearm is in the firing position.

3. The system of claim 1, wherein the timer device is further configured to start the timer in response to the user pressing an activation button on the timer device prior to the act of shooting the firearm.

4. The system of claim 1, wherein the recoil detecting device is configured to be attached to a user's hand and to sense hand movement during and immediately after the act of shooting.

5. The system of claim 4, wherein the recoil detecting device is configured to be attached to a finger of the user, and wherein the user device is further configured to compute the at least one performance metric based on a correlation between finger motion sensed by the recoil detecting device and recoil of the firearm.

6. The system of claim 1, wherein the recoil detecting device is attached to the firearm.

7. The system of claim 6, wherein the recoil detecting device is configured to be attached to a trigger guard of the firearm.

8. The system of claim 1, wherein the recoil detecting device and the timer device are provided as a single integrated device that is configured to wirelessly transmit the time-stamped motion data and the timing information to the user device.

9. The system of claim 1, wherein the information outputted to the user is outputted using a graphical user interface (GUI) that presents the at least one performance metric in association with the elapsed time between pulling the trigger and the bullet leaving the barrel.

10. The system of claim 9, wherein the GUI is further configured to display activity information for multiple shooters, and to present for each shooter the at least one performance metric computed from that shooter's recoil profile.

11. The system of claim 10, wherein the activity information includes a leaderboard in which shooters are ranked based on the at least one performance metric that combines at least one recoil-stability component derived from the recoil profile and at least one timing component derived from the elapsed time between pulling the trigger and the bullet leaving the barrel of the firearm.

12. The system of claim 9, wherein the GUI uses graphs to display the recoil profile as a function of time together with the at least one performance metric to the user.

13. The system of claim 9, wherein the information is transmitted from the user device to a social networking website or app and the social networking website or app displays, for multiple users, respective performance metrics computed from recoil profiles of the multiple users.

14. The system of claim 13, wherein the information outputted via the social networking website or app includes a leaderboard, scores, or contest results in which users are ranked according to their respective performance metrics.

15. A firearm analysis method for use with a firearm with a trigger, comprising:

detecting, by a recoil detecting method, forces that a user experiences when firing a firearm by analyzing motion data from movement sensors which measure movement of the firearm when it is fired at discrete sampling intervals to generate impulse waveforms corresponding to recoil;

executing a timer method for timing firearm movement, the timer method including detecting an act of shooting the firearm and controlling timing measurement based on receiving information from the recoil detecting method identifying a recoil event corresponding to discharge of the firearm;

computing, by a user device, at least one performance metric for the user that combines (i) timing data related to firing the firearm as determined by the timer method, and (ii) accuracy data derived from characteristics of the impulse waveforms measured over the discrete sampling intervals as determined by the recoil detecting method; and displaying to the user, on a display of the user device, information including an elapsed time related to firing the firearm, an elapsed time between firings, and the at least one performance metric that combines the timing data and accuracy data.

16. A computer program stored on a non-transitory medium for analyzing a firearm with a trigger, the computer program including instructions which, when executed by at least one processor of a user device, cause the at least one processor to perform operations comprising:

receiving motion data representing movement of a firearm when it is fired, the motion data being generated by movement sensors of a recoil detecting device at discrete sampling intervals and representing impulse waveforms corresponding to recoil; receiving timing information related to firing the firearm, the timing information being generated by a timer method that uses detection of a recoil event corresponding to discharge of the firearm;

computing at least one performance metric for a user that combines (i) timing data related to firing the firearm, and (ii) accuracy data derived from characteristics of the impulse waveforms measured over the discrete sampling intervals; and displaying, on a display of the user device, information including an elapsed time related to firing the firearm, an elapsed time between firings, and the at least one performance metric that combines the timing data and accuracy data.

* * * * *